US009289647B2

(12) United States Patent
Merli

(10) Patent No.: US 9,289,647 B2
(45) **Date of Patent: *Mar. 22, 2016**

(54) SEATED EXERCISE APPARATUS

(71) Applicant: Flatiron Design, LLC, Boulder, CO (US)

(72) Inventor: Christopher R Merli, Boulder, CO (US)

(73) Assignee: FLATIRON DESIGN, LLC, Boulder, CO (US)

( * ) Notice: Subject to any disclaimer, the term of this patent is extended or adjusted under 35 U.S.C. 154(b) by 93 days.

This patent is subject to a terminal disclaimer.

(21) Appl. No.: 14/048,302

(22) Filed: Oct. 8, 2013

(65) Prior Publication Data

US 2014/0038789 A1 Feb. 6, 2014

Related U.S. Application Data

(63) Continuation-in-part of application No. 12/899,383, filed on Oct. 6, 2010, now Pat. No. 8,562,491, which is a continuation-in-part of application No. 12/209,016, filed on Sep. 11, 2008, now Pat. No. 7,815,551.

(60) Provisional application No. 60/993,534, filed on Sep. 13, 2007.

(51) Int. Cl.

| | |
|---|---|
| ***A63B 22/04*** | (2006.01) |
| ***A63B 22/00*** | (2006.01) |
| ***A63B 22/12*** | (2006.01) |
| ***A63B 22/06*** | (2006.01) |
| *A63B 21/005* | (2006.01) |
| *A63B 21/008* | (2006.01) |
| *A63B 21/012* | (2006.01) |
| *A63B 21/22* | (2006.01) |
| *A63B 71/02* | (2006.01) |

(52) U.S. Cl.

CPC ..... *A63B 22/001* (2013.01); *A63B 22/06* (2013.01); *A63B 22/0664* (2013.01); *A63B 21/0051* (2013.01); *A63B 21/0053* (2013.01); *A63B 21/0088* (2013.01); *A63B 21/012* (2013.01); *A63B 21/225* (2013.01); *A63B 2022/067* (2013.01); *A63B 2071/025* (2013.01); *A63B 2208/0233* (2013.01); *A63B 2225/09* (2013.01)

(58) Field of Classification Search

USPC ..... 482/51–52, 63, 70–71, 62

See application file for complete search history.

(56) References Cited

U.S. PATENT DOCUMENTS

| | | | | |
|---|---|---|---|---|
| 5,916,065 | A * | 6/1999 | McBride et al. | 482/57 |
| 2004/0259692 | A1* | 12/2004 | Martin et al. | 482/52 |
| 2006/0281604 | A1* | 12/2006 | Stewart et al. | 482/51 |
| 2008/0139366 | A1* | 6/2008 | Born et al. | 482/52 |

* cited by examiner

*Primary Examiner* — Loan H Thanh
*Assistant Examiner* — Shila Jalalzadeh Abyane
(74) *Attorney, Agent, or Firm* — Vista IP Law Group LLP

(57) ABSTRACT

A seated exercise apparatus comprises a frame having a seat attached to the frame. A pair of opposed cranks are rotatably coupled to the frame such that they rotate about a first axis. A medial portion of each of a pair of elongated members is rotatably connected to the frame at a respective pivot joint. A first end of each elongated member has a handle and a second end of each elongated member is rotatably connected to a one end of a respective pedal arm. The pivot joints are located outside of a plane of motion of their respective right and left pedals, such that the apparatus can fit within a more compact form factor, especially in a longitudinal dimension. The pedals move in a reciprocating path having an elliptical shape, in which the major axis is more vertical than horizontal, giving a more up and down, natural, pedal motion.

11 Claims, 11 Drawing Sheets

SEATED EXERCISE APPARATUS

RELATED APPLICATIONS

This application is a continuation-in-part of U.S. patent application Ser. No. 12/899,383, filed Oct. 6, 2010, now U.S. Pat. No. 8,562,491 B2, issued Oct. 22, 2013, which is a continuation-in-part of U.S. patent application Ser. No. 12/209,016, filed Sep. 11, 2008, now U.S. Pat. No. 7,815,551 B2, issued which claims the benefit of U.S. provisional Application No. 60/993,534, filed on Sep. 13, 2007. Priority to the aforementioned applications is hereby expressly claimed in accordance with 35 U.S.C. Section 119(e), 120, and any other applicable laws. The aforementioned applications are hereby incorporated by reference herein in their entirety.

FIELD OF THE INVENTION

The present invention relates to a seated exercise apparatus which is operated in a seated position and which includes foot pedals that move in a reciprocating motion coordinated with handles that move in a reciprocating motion.

BACKGROUND OF THE INVENTION

The benefits of regular exercise are well known and there is always a search for a full body exercise device that can achieve maximum benefit to the user while minimizing impact on their joints. Historically recumbent and upright exercise cycles have been a low impact way of achieving cardiovascular benefit. Recumbent cycles offer the user a much more safe, comfortable and easy-to-use device than an upright exercise cycle and have become very popular among the aging population. More recently recumbent exercise devices have been developed to include a reciprocating or elliptical foot motion.

For example, U.S. Pat. No. 5,514,053 to Hawkins shows a recumbent exercise device with stepping motion but no articulation for the foot. U.S. Pat. No. 5,106,081 to Webb shows a leg exercise machine with an arc motion that is associated with a weight stack. U.S. Pat. No. 6,790,162 Ellis et al. shows a recumbent stepper with independently moving arms. U.S. Pat. No. 6,932,745 to Ellis shows a recumbent exercise apparatus with arcuate foot motion.

Yet another group of recumbent exercise apparatus' has emerged that include coordinated arm movement to achieve a full body workout and, therefore, a higher level of cardiovascular benefit. U.S. Pat. Nos. 5,356,356, 6,042,518, and 6,666,799 all to Hildebrandt et al. show a recumbent apparatus with stepping motion and coordinated arm movement. U.S. Pat. No. 5,611,758 to Rodgers. Jr. shows a recumbent exercise apparatus with elliptical pedal motion using a crank, reciprocating member and roller/track to guide a pedal/foot member pivotally connected to the reciprocating member and includes coordinated arm member movement. U.S. Pat. No. 5,836,855 to Eschenbach, U.S. Pat. Nos. 5,938,570 and 6,409,635 both to Maresh et al., and U.S. Patent Application No. US2004/0259692 to Martin et al. each show pedal movements for a semi-recumbent exerciser. U.S. Patent Application No. 2007/0099764 to Eschenbach describes a recumbent device with elliptical foot motion. The elliptical foot motion is achieved by means of a track system in the preferred embodiment. In an alternative embodiment, elliptical motion is achieved by connection to a rocker link. U.S. Pat. Nos. 6,077,197 and 6,283,895 both to Stearns et al. show inclined pedals and elliptical foot motion where the user is stabilized by leaning against a back support. U.S. Pat. No. 5,916,065 to McBride et al. shows a traditional stand up elliptical configured for use by a seated operator.

Accordingly, there is a need for a seated exercise apparatus with reciprocating foot movement in a generally up and down motion that allows the feet of the user to be generally outside of the bending knee to reduce stress in this area while allowing the foot to articulate in a relatively natural motion. Furthermore, there is a need for a simple, easy to manufacture linkage design without the use of expensive rollers and tracking systems to achieve this motion. Finally there is a need for an apparatus with coordinated arms which do not interfere with the operator's access to the seated area, so that the aging population can use the device without having to get around the moving arms.

SUMMARY OF THE INVENTION

The present invention is directed to a seated exercise apparatus. The seated exercise apparatus comprises a frame and a seat attached to the frame. The seat is configured to support a user in a relatively upright seated position. The frame may include a base portion, which is typically configured to rest firmly on the floor thereby supporting the apparatus. A longitudinal axis of the frame is defined as the axis through the middle of the seat and in the direction along which the seat (and thus the user) faces. The apparatus has a first side located on one side of the longitudinal axis and a second side located on the opposing side of the longitudinal axis. The front of the apparatus (in the direction the seat and seated user face) is defined as the proximal direction, and the back of the apparatus is defined as the distal direction.

First and second cranks are rotatably coupled to the frame in an opposed position such that they rotate about a first axis substantially perpendicular to the longitudinal axis. The first and second cranks may be attached to a pulley which is in turn rotatably mounted to the frame such that it rotates about the first axis.

A first elongated member having a first end, a second end, and a medial portion is disposed on the first side of the apparatus. The medial portion of the first elongated member is rotatably connected to the frame such that the first elongated member may rotate about a second axis which is substantially perpendicular to the longitudinal axis of the frame. Similarly, a second elongated member having a first end, a second end, and a medial portion is disposed on the second side of the apparatus. The second elongated member is rotatably connected to the frame at the medial portion of the second elongated member such that the second elongated member also may rotate about the second axis. Optionally, each first end of the elongated members has a handle for the user to hold with each hand. The medial portion of the first and second elongated members may be positioned proximal the seat.

A first pedal arm having a first end, a second end and pivot portion is disposed on the first side of the apparatus distal of the first elongated member. The first end of the first pedal arm is rotatably connected to the second end of the first crank. A pedal configured to support the foot of the user is operably connected to the first pedal arm proximate the second end of the pedal arm. The pivot portion of the first pedal arm is rotatably connected to the second end of the first elongated member, such that a downward force on the pedal causes (i) the first crank to rotate about the first axis, (ii) the first elongated member to rotate about the second axis, (iii) and the first pedal to move in a steep up and down reciprocating motion.

Likewise, a second pedal arm having a first end, a second end and a pivot portion is disposed on the second side of the apparatus distal of the second elongated member. The first end of the second pedal arm is rotatably connected to the second end of the second crank. The pivot portion of the second pedal arm is rotatably connected to the second end of the second elongated member, such that a downward force on the pedal causes (i) the second crank to rotate about the first axis, (ii) the second elongated member to rotate about the second axis, (iii) and the second pedal to move in a steep up and down reciprocating motion. In one embodiment, the first and second pedals move along an elongated curvilinear (generally elliptical) having a major axis (the longest diameter of the shape) that is more vertical than horizontal.

In another embodiment of the invention, the first and second pedals move along an elongated curvilinear path that is self-intersecting. In other words, the path intersects itself at some point along the path such that a point on the pedal is in the same position at two different points along the path.

In still another aspect of the present invention, the handles are invertible such that they can be placed in an upper position or a lower position, the upper position being higher than the lower position, relative to the first end of the elongated member to which the handles are attached. In the upper position, the movement of the handles exercises the shoulders and back, and in the lower position, the movement of the handles exercises the biceps and triceps.

As the pedals are reciprocated up and down, the handles, if provided, move in coordination with the motion of the cranks resulting in an arcuate motion of the handles about the second axis.

In still another embodiment, which may advantageously be in a more compact form factor than other embodiments, the medial portion of the first elongated member is rotatably connected to the frame at a first pivot joint which is located to the outside of the plane of motion of the entire first pedal, but also within a transverse projection of the path (a projection perpendicular to the plane of the path of the entire pedal). In other words, the first pivot joint of the first elongated member is located to the right side (the directional terms "right", "left", "forward" and "backward" are relative to the orientation of a person seated facing forward in the seat of the apparatus) of the plane of motion of the entire first pedal. In this way, the first pedal may extend forward of the first pivot joint without hitting or interfering with the first elongated member. Similarly, the medial portion of the second elongated member is rotatably connected to the frame at a second pivot joint which is located to the outside of the plane of motion of the entire second pedal, but also within a transverse projection of the plane of motion. In other words, the second pivot joint of the second elongated member is located to the left side of the plane of motion of the entire second pedal, such that the second pedal may extend forward of the second pivot joint without hitting or interfering with the second elongated member. This allows the frame of the apparatus to be smaller and the overall size of the apparatus to be smaller, for example shorter in the longitudinal dimension, than if the pivot joints were located within the plane of motion of the pedals such that the pivot joints must be located outside (e.g. forward) of the path of the pedals. The frame is configured to route to the outside of the plane of motion of the pedals to provide a frame structure for the pivot joints located to the outside of the plane of motion of the pedals.

Thus, the present invention provides the user with coordinated seated exercise of both the arms/hands and legs/feet. The feet move in a generally reciprocating motion and articulate in a manner which is natural to the preferred movement of the ankle. If handles are provided, the user's hands and arms are coordinated with this foot motion in a generally arcuate motion.

Additional aspects and features of the seated exercise apparatus and related mechanisms of the present invention will become apparent from the drawings and detailed description provided below.

BRIEF DESCRIPTION OF THE DRAWINGS

The invention is illustrated by way of example and not limitation in the figures of the accompanying drawings, in which like reference numbers refer to similar elements, and in which.

DETAILED DESCRIPTION OF THE INVENTION

Figure 1:
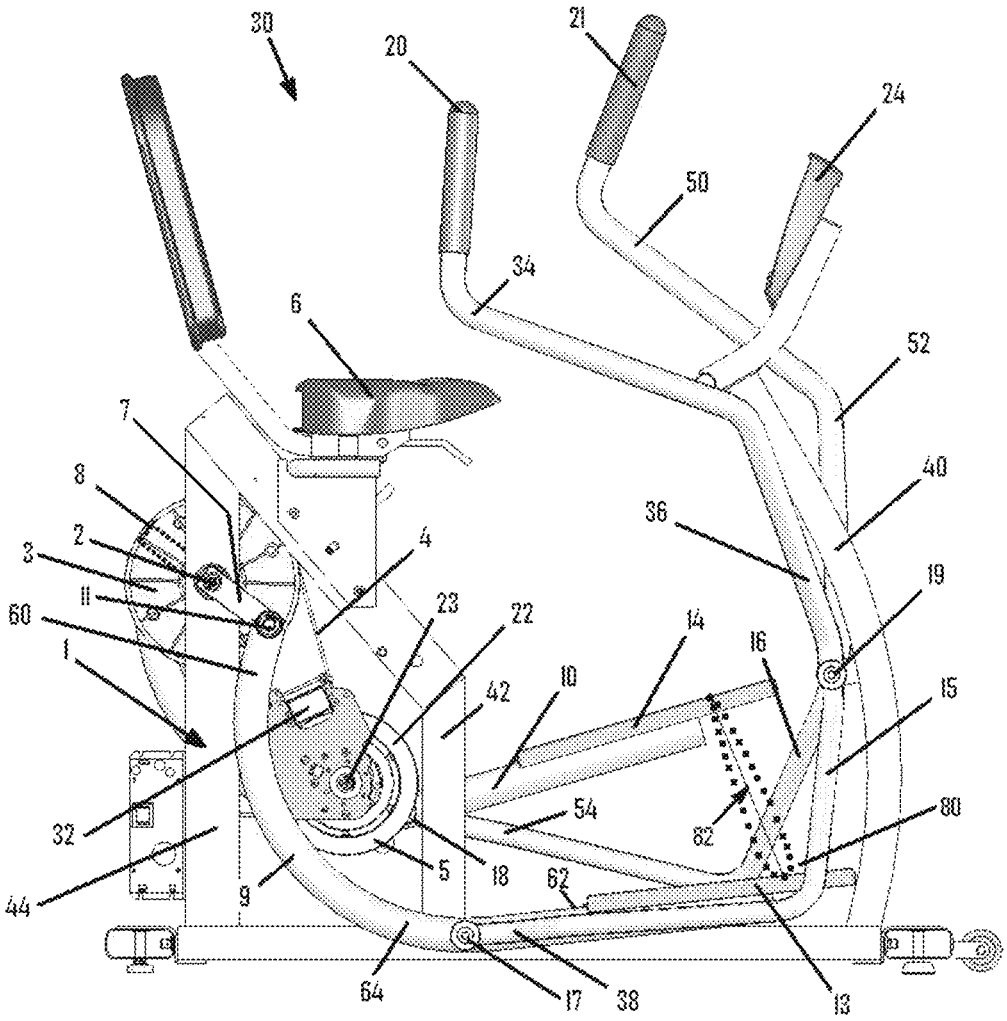
FIG. 1 is a side elevation view of one embodiment of the present invention.
Figure 2:
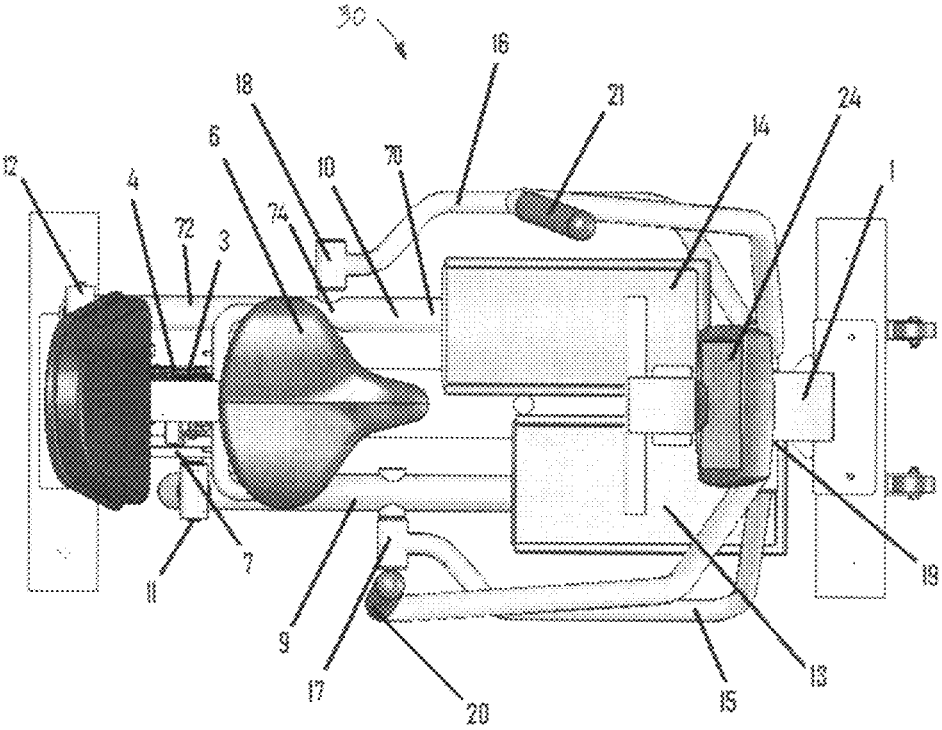
FIG. 2 is a plan view of the embodiment of FIG. 1.

Referring to FIGS. 1 and 2, an exemplary embodiment of a seated exercise apparatus 30 is shown. The seated exercise apparatus 30 comprises a frame 1 which may be constructed of any suitably strong material, such as steel, aluminum, composite, or other suitable material(s). The frame 1 includes a base portion which extends from the back or distal end to the front or proximal end of the apparatus 30, along a longitudinal axis extending through the middle of the seat 6. The longitudinal axis also divides the apparatus horizontally into a first side on one side of the longitudinal axis and a second side on the other side of the longitudinal axis. In other words, the first side of the apparatus 30 is the right side of the user seated in the seat 6, and the second side is the left side, or vice versa. The base portion has four feet having adjustable heights which provide for a firm and stable foundation on a support surface such as the floor, and also allows for some leveling of the apparatus 1. The frame 1 further includes a plurality of risers, including in this exemplary embodiment, a front riser 40, a seat riser 42, and a crank riser 44.

A seat 6 is attached to the seat riser. The seat 6 and seat riser 42 may be configured to adjust the seat position. In this example, the seat riser 42 includes a plurality of positions which adjust the seat's vertical and horizontal position so that the seat 6 can be adjusted to fit the particular user. The seat 6 may include a seat back. The seat 6 is oriented to position the user in a substantially upright seated position.

A first crank 7 and second crank 8, each having a first end, and a second end are arranged substantially opposed to each other and positioned below and distal the seat 6. The first end of the first and second cranks 7, 8 are rotatably coupled to the frame 1 at the crank riser 44, such as through an axle, sleeve and bearings, or other suitable structure, such that the first and second cranks 7, 8 rotate about a first axis 2 defined by the axle, where the first axis 2 is substantially perpendicular to the longitudinal axis of the apparatus 30. The first crank 7 and second crank 8 are typically disposed on opposing sides of the axle. The first and second cranks 7, 8 may be rotatably coupled to the frame through attachment to pulley 3 which is coupled to the frame using, for example, an axle, sleeve, and bearings, or other suitable structure.

A flywheel 22 is rotatably coupled to the frame 1 at the crank riser 44 through a pivot axis 23, below and slightly proximal of the pulley 22 and first and second cranks 7, 8. The flywheel 22 is operably coupled to the pulley 3 by a belt 4. The belt 4 may be a chain, a belt, or other suitable, flexible engagement. An adjustable load resistance device 32 is operably coupled to the flywheel 22, and in turn to the pulley 3, to provide an adjustable load resistance on the pulley 3. The load resistance device 32 may use magnetic resistance, friction, an alternator, a fan, or other suitable adjustable load resistance mechanism. The load resistance device 32 may be operably coupled to a user console 24 configured to adjust the load resistance.

A first elongated member 15 having is provided on the first side of the apparatus 30. The first elongated member 15 includes a first end 34, a second end 38, and a medial portion 36. The first end 34 is positioned generally proximal of a seated user and to the outside of the seat 6. The first end 34 has a handle 20 for a user to grip with their right hand. The first elongated member 15 extends from the handle 20 in a forward direction toward the proximal end of the apparatus 30. The medial portion 36 of the first elongated member 15 is positioned proximal the seat 6 and extends generally vertically downward so that it provides room for a user to mount the seat 6 without being hindered by the first elongated member 15 or the handle 20. The medial portion 36 is rotatably connected to the frame 1 at the front riser 40 at a second axis 19 which is transverse to the longitudinal axis, such that the first elongated member 15 rotates about the second axis 19. The first elongated member 15 then extends from the generally vertical medial potion 36 through a curved portion and along a generally horizontal portion to the second end 38, which is positioned near the bottom of the apparatus 30.

A second elongated member 16 is disposed on the second side of the apparatus 30, and is a mirror image of the first elongated member 15, in both structure and coupling to the apparatus 30. The second elongated member 16 includes a first end 50, a second end 54, and a medial portion 52. The first end 50 is positioned generally proximal of a seated user and to the outside of the seat 6. The first end 50 has a handle 21 for a user to grip with their right hand. The second elongated member 16 extends from the handle 21 in a forward direction toward the proximal end of the apparatus 30. The medial portion 52 of the second elongated member 16 is positioned proximal the seat 6 and extends generally vertically downward so that it provides room for a user to mount the seat 6 without being hindered by the second elongated member 16 or the handle 21. The medial portion 52 is rotatably connected to the frame 6 at the front riser 40 at the second axis 19, such that the second elongated member 16 rotates about the second axis 19. The second elongated member 16 then extends from the generally vertical medial potion 52 through a curved portion and along a generally horizontal portion to the second end 54, which is positioned near the bottom of the apparatus 30.

In another embodiment (not shown in the figures), the seated exercise apparatus 30 can be provided without handles 20 and 21 on the elongated members 15 and 16. In this embodiment, the elongated members 15 and 16 may end at the medial portions 36 and 52, respectively, or they may even end at the connection to the second axis 19. The seated exercise apparatus provide a leg exercise, only. In another aspect, the handles 20 and 21 may be removably attached to the elongated members 20 and 21, such that they could be installed if the user wants to use them, or removed if the user does not want to use them. The removable handles 20 and 21 include the upper portion of the elongated members 15 and 16, including the first ends 34 and 50. Then, the handles 20 and 21, and the upper portion of the elongated members 15 and 16 are removably coupled to the elongated members 20 and 21 at or proximate the connection to the second axis 19. For example, the handles 20 and 21 may each include a tube having a lower end that is coaxially received (inside or outside) by the upper end of the elongated members 15 and 16. A locking device can be used to lock the handles 20 and 21 in place on the elongated members 15 and 16. The locking device could be a spring loaded pin and detent mechanism, a locking screw, or other suitable device.

A first pedal arm 9 having a first end 60, a second end 62, and a pivot portion 64 is disposed on the first side of the apparatus 30, with the first end 60 distal of the first elongated member 15 and the second end 62 proximal of the second end 38 of the first elongated member 15. The first end 60 of the pedal arm 9 is rotatably connected to the second end of the first crank 7 at pivot 11. The pivot portion 64 of the first pedal arm 9 is rotatably connected to the second end 38 of the first elongated member 15 at pivot 17. A first pedal 13 configured to support the right foot of the user is operably connected to the first pedal arm 15 proximate the second end 62 of the first pedal arm 9. The location of the pivot 17 relative to the first pedal 13 will determine the up and down motion of the first pedal 13, and can be changed according to the present invention. For example, if the pivot 17 is located distal of the first pedal 13, the first pedal 13 will have a reciprocating motion up and down in a generally elliptical path. If the first pedal 13 is placed directly over the pivot 17, then the first pedal 13 will move in a reciprocating motion up and down motion in an arcuate path. The more the pivot 17 is moved distally of the first pedal 13, the more elliptical the pedal path will be. Thus, a downward force on the first pedal 13 causes the first crank 7 to rotate in a counterclockwise direction about the first axis 2, in turn the first elongated member 15 rotates about the second axis 19, and the first pedal 13 moves in a steep up and down reciprocating motion (which may be arcuate or elliptical). The rotation of the first elongated member 15 about the second axis 19 causes the handle 20 to move through a reciprocating arcuate motion, which provides for coordinated movement of the first pedal 13 and the handle 20 (i.e. a complete cycle of the first pedal 13 corresponds to a complete cycle of the handle 20).

Likewise, a second pedal arm 10 having a first end 70, a second end 72, and a pivot portion 74 is disposed on the second side of the apparatus 30, with the first end 70 distal of the second elongated member 16 and the second end 72 proximal of the second end 54 of the second elongated member 16. The first end 70 of the second arm 10 is rotatably connected to the second end of the second crank 8 at pivot 12. The pivot portion 74 of the second pedal arm 10 is rotatably connected to the second end 54 of the second elongated member 16 at pivot 18. A second pedal 14 configured to support the left foot of the user is operably connected to the second pedal arm 16 proximate the second end 72 of the second pedal arm 10. The location of the pivot 18 relative to the second pedal 14 will determine the up and down motion of the second pedal 14, and can be changed according to the present invention. For example, if the pivot 18 is located distal of the second pedal 14, the second pedal 14 will have a reciprocating motion up and down in a generally elliptical path. If the second pedal 14 is placed directly over the pivot 18, then the second pedal 14 will move in a reciprocating motion up and down motion in an arcuate path. The more the pivot 18 is moved distally of the second pedal 14, the more elliptical the pedal path will be. Similar to the first pedal 13 described above, a downward force on the second pedal 14 causes the first crank 8 to rotate in a clockwise direction (when facing the first crank 8) about the first axis 2, in turn the second elongated member 16 rotates about the second axis 19, and the second pedal 14 moves in a steep up and down reciprocating motion (which may be arcuate or elliptical). The rotation of the second elongated member 16 about the second axis 19 causes the handle 21 to move through a reciprocating arcuate motion, which provides for coordinated movement of the second pedal 14 and the handle 10.

Figure 3:
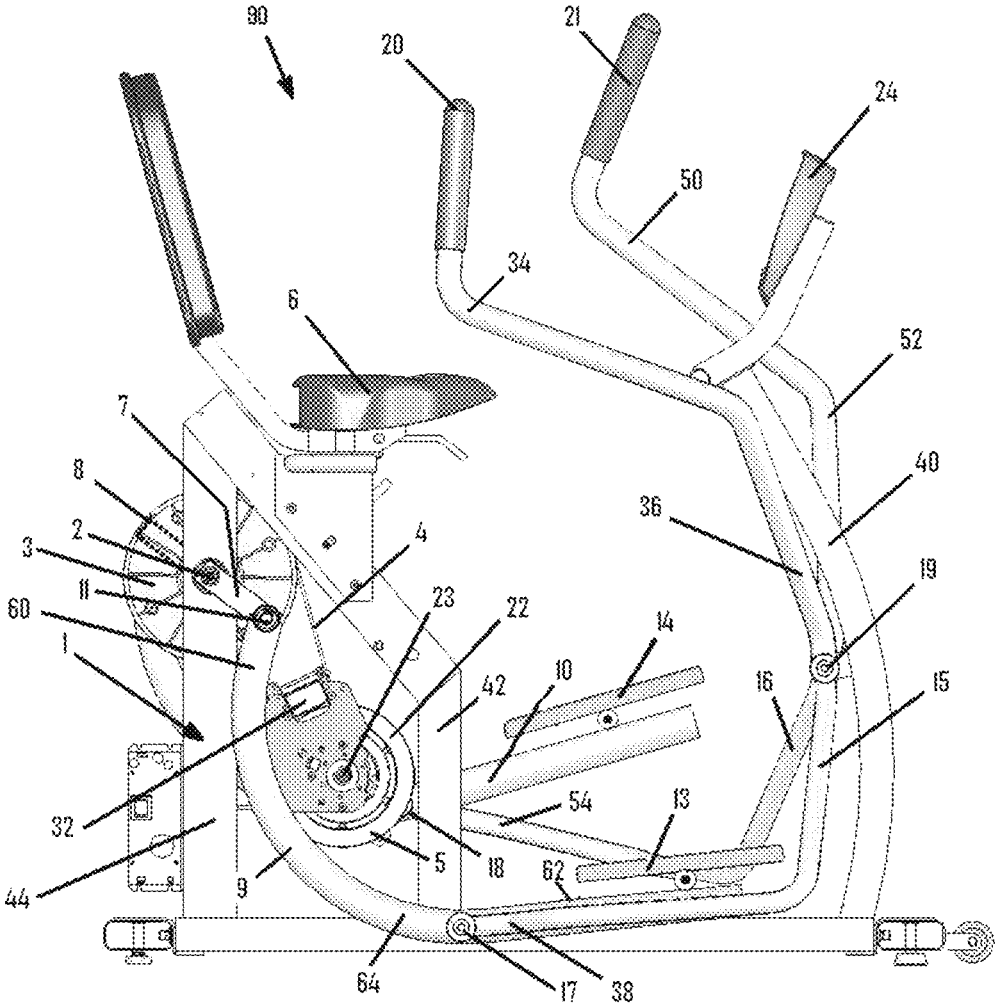
FIG. 3 is a side elevation view of another embodiment of the present invention.

Referring now to FIG. 3, another embodiment of a seated exercise apparatus 90 is shown, which is identical to the seated exercise apparatus 30, except that the first pedal 13 is rotatably connected to the first pedal arm 9 and the second pedal 14 is rotatably connected to the second pedal arm 10. The pedals 13 and 14 can be rotatably coupled to the respective pedal arms 9 and 10 by any suitable means, such as a rotating pin and sleeve arrangement with the sleeve connected to one of the structures and the pin connected to the other structure.

The apparatus 30 is configured such that the major axis of the reciprocating path of the first and second pedals 13, 14 is substantially vertical, and preferably at an angle of greater than 45 degrees to horizontal (or the floor) or 60 degrees to horizontal, or at an angle of greater than 70 degrees horizontal, or at an angle of greater than 80 degrees to horizontal (wherein vertical to horizontal is 90 degrees). This more vertical up and down motion of the pedal 13, 14 provides a more natural motion and creates less stress on the joints than the devices described above in which the pedals travel on a more horizontal path as the user is in a reclined position. Alternatively, the apparatus 30 may provide a more recumbent path in which the major axis of the path of the first and second pedals 13,14 is at an angle of 45 degrees or less to horizontal (or the floor).

During operation the user sits in a generally upright position with their body supported by seat 6. The user applies force to the first and second pedals 13, 14 resulting in a foot motion that is generally reciprocating. First and second pedals 13, 14 articulate in a manner that allows plantar flexion in the lower pedal position and dorsi flexion in the upper pedal position. The first and second handles 20, 21 move in an arcuate motion during operation of the first and second pedals 13, 14. As all of the moving parts are coupled at least indirectly to the rotation of the pulley 3, the motion of the first and second pedals 13, 14 and the first and second handles 20, 21 are coordinated.

The first and second pedals 13, 14 throughout their motion are located proximal of the seat 16. Thus, it can be seen that the exercise apparatus 30 places less stress on the user's knees and is easily accessible for older users. Moreover, the apparatus 30 uses relatively simple pivot mechanisms, making the device easy to manufacture and assemble.

Turning now to FIGS. 4-8, another embodiment of a seated exercise apparatus 30 is shown. The embodiment of FIGS. 4-8 is very similar to the embodiments of FIGS. 1-3, except for a few modifications as described below. Accordingly, like reference numerals refer to like elements among the embodiments, and the description of such elements above with respect to FIGS. 1-3 applies equally to the elements shown in FIGS. 4-8. Thus, such descriptions are not repeated.

The major differences in the embodiment of FIGS. 4-8 are the invertible, adjustable handles 93 and 99, and the modification of the pedal paths 89 to a closed curvilinear path that is self-intersecting at an intersection point 105.

Beginning with a description of the invertible handles shown in FIGS. 4 and 6-8, the first end 34 of the first elongated member 15 includes a slider tube 91, a first adjustment pin 92 and a first adjustable handle 93. The first adjustable handle 93 has a tubular portion 84, a vertical grip 94 (preferably oriented within 30 degrees or less to vertical) and a horizontal grip 95 (preferably oriented within 30 degrees or less to horizontal) which allows the user to hold the first adjustable handle 93 in different positions. The tubular portion 84 is slidably received within the first slider tube 91 to connect the first adjustable handle 93 to the first end 34 of the first elongated member 15. The adjustment pin 92 releasably locks the first adjustable handle 93 in a set position to the first end 34 of the first elongated member 15. Other suitable locking devices may be used in place of the adjustment pin 92, such as a pin and detent mechanism.

Similarly for the second adjustable handle 99 on the other side of the apparatus 30, the first end 50 of the second elongated member 52 includes a slider tube 97, an adjustment pin 98 and a first adjustable handle 99. The first adjustable handle 99 has a tubular portion 85, a vertical grip 100 (preferably oriented within 30 degrees or less to vertical) and a horizontal grip 101 (preferably oriented within 30 degrees or less to horizontal) which allows the user to hold the first adjustable handle 99 in different positions. The tubular portion 85 is slidably received within the slider tube 97 to connect the second adjustable handle 99 to the first end 50 of the second elongated member 52. The adjustment pin 98 releasably locks the second adjustable handle 99 in a set position to the first end 50 of the second elongated member 52. Again, other suitable locking devices may be used in place of the adjustment pin 98, such as a pin and detent mechanism.

Figure 6:
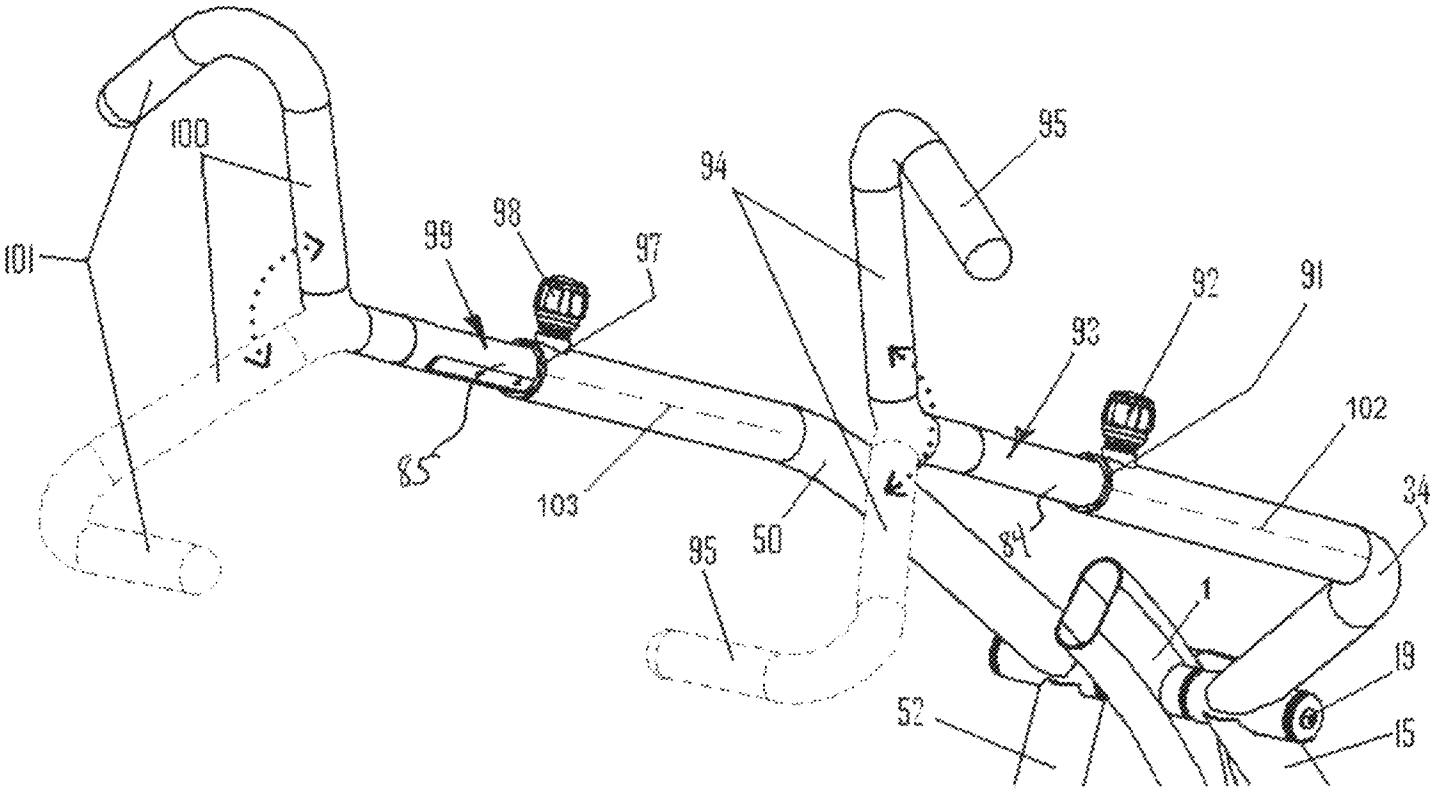
FIG. 6 is an enlarged, partial perspective view of the embodiment of FIG. 4, showing the adjustable handles.
Figure 7:
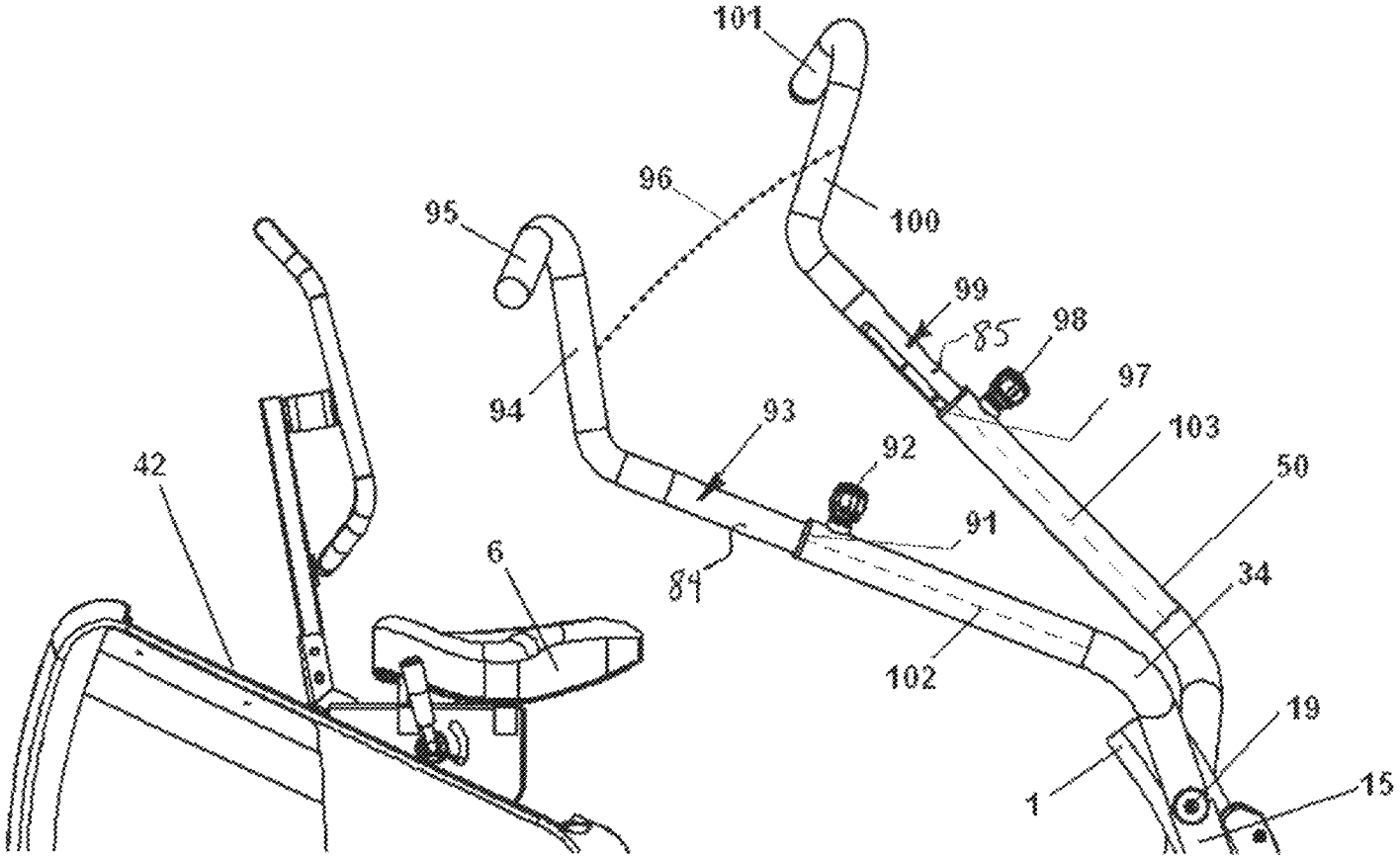
FIG. 7 is an enlarged, partial side view of the embodiment of FIG. 4, showing the adjustable handles in the upper position.

As shown in FIG. 6, the first and second adjustable handles 93 and 99 can easily be inverted to move the handles from an upper position shown in solid lines to a lower position shown in dashed lines. The handles 93 and 99 are adjusted between the upper position and lower position simply by releasing the adjustment pins 92, 98, and rotating the adjustable handles 93 and 99 about the concentric axes 102, 103 of the tubular portions 84, 85 and slider tubes 91, 97, thereby rotating tubular portions 84, 85 within the slider tubes 91, 97, respectively. The first and second adjustable handles 93, 99 can also be adjusted As shown in FIG. 7, the first and second adjustable handles 93 and 99 are in the upper position. In the upper position, the vertical grips 94, 100 are in a substantially vertical position. In this upper position of the handles, while holding the vertical grips 94, 100, the movement of the handles 93, 99 allows the user to exercise their chest and back muscles, by pushing and pulling through an upper arcuate motion 96.

Figure 4:
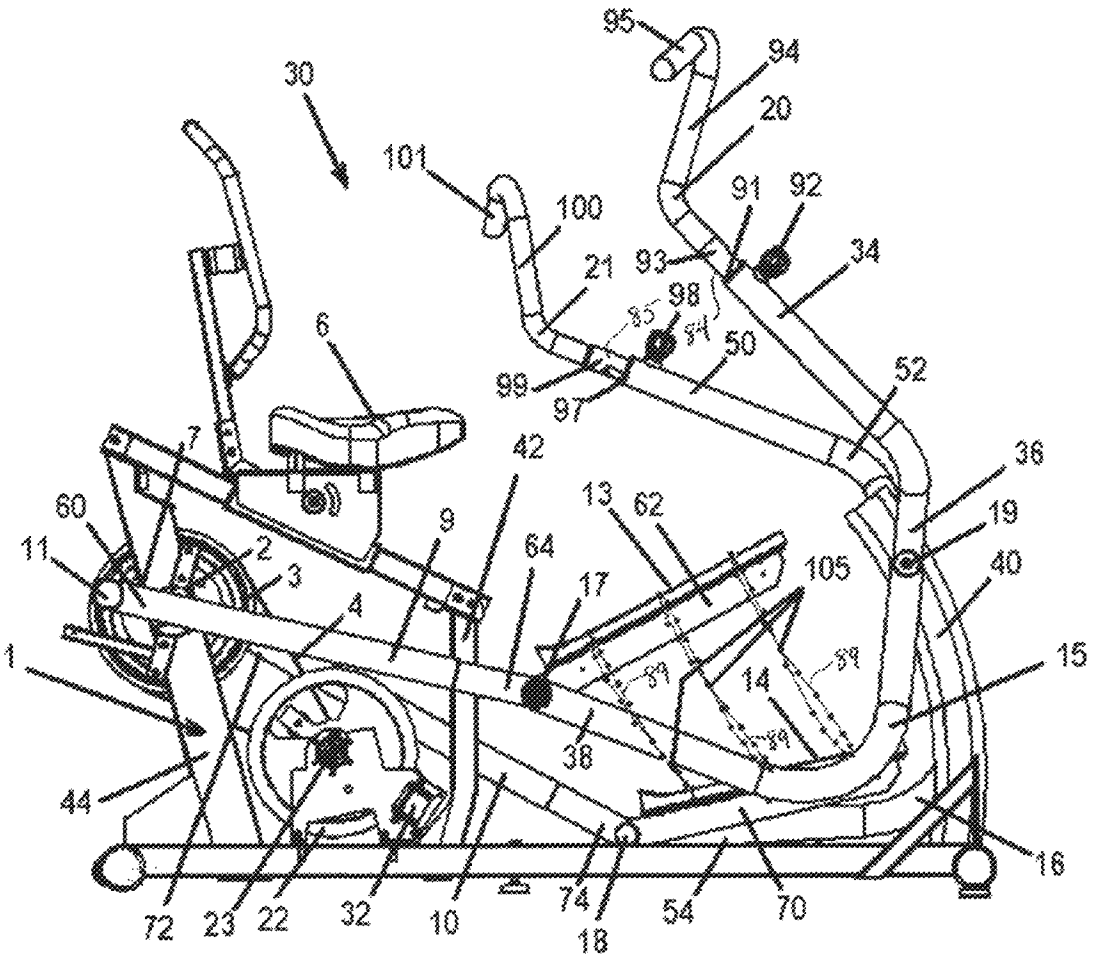
FIG. 4 is a side elevation view of still another embodiment of the present invention.
Figure 5:
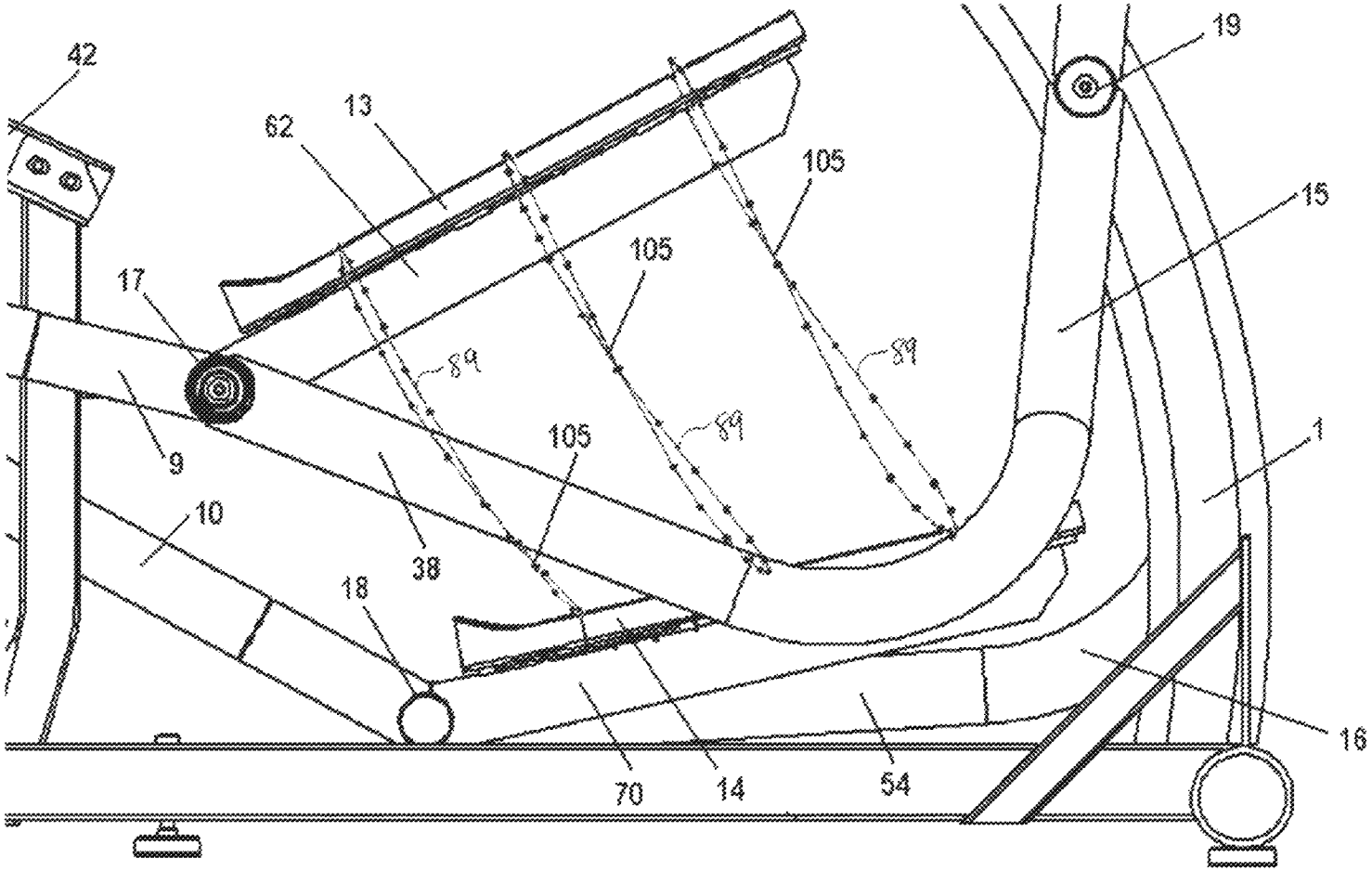
FIG. 5 is an enlarged, partial side elevation view of the embodiment of FIG. 4, showing the pedal paths.
Figure 8:
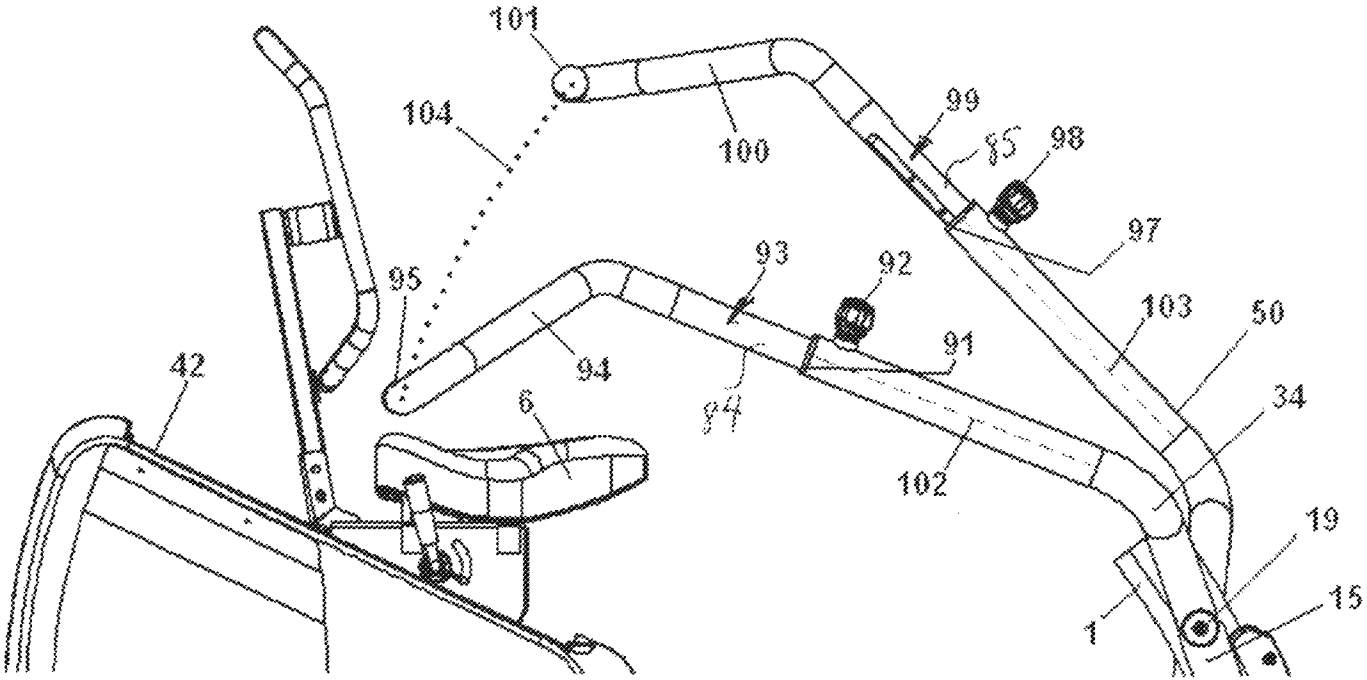
FIG. 8 is an enlarged, partial side view of the embodiment of FIG. 4, showing the adjustable handles in the lower position.

As shown in FIG. 8, the first and second adjustable handles 93 and 99 are in the lower position. Thus, the horizontal grips 95, 101 become positioned generally horizontal with respect to the floor and generally perpendicular to the longitudinal axis of the apparatus 30. In this lower position, the horizontal grips 95, 101 are in a generally lower position and closer to the seated user. In the lower position, while holding the horizontal hand grips 94,100, the movement of the handles 93, 99 allows the user to exercise their biceps and triceps by pushing and pulling through a lower arcuate motion 104. Referring now to FIGS. 4 and 5, the closed curvilinear path 89 of the first and second pedals 13, 14 is shown. The path 89 of the embodiment of FIGS. 4-8 is different than the path 80 of the embodiments of FIGS. 1-3 due to the different configuration of several of the components, such as the shape of the pedal arms and the elongated members, and the locations of the pedals and pivots connecting these elements. The different paths 89 shown in FIGS. 4 and 5 show the paths at different points on the pedals 13, 14. In each case, the path 89 is a closed curvilinear path that self-intersects at an intersection point 105. In other words, the width between the path on the up-stroke and the down-stroke of the pedal converges to zero. The shape of the path looks like a very elongated figure eight. As can be best seen in FIG. 5, the point of intersection 105 is different for different locations on the pedals 13, 14. At the rear of the pedals 13, 14, the intersection point 105 is near the bottom of the path: near the middle of the pedals 13, 14, the intersection point is near the middle of the path; and the intersection point at the front of the pedals 13, 14 is near the top of the path. Accordingly, the path 105 is fairly straight, in a steep up and down motion. The major axis (a line between the top point of the path and the bottom point of the path) of the path 105 is preferably at an angles of greater than 45 degrees to the floor, or at an angle of greater than 70 degrees to the floor, or at an angle of greater than 80 degrees to the floor 9 (wherein vertical to the floor is 90 degrees).

Figure 9:
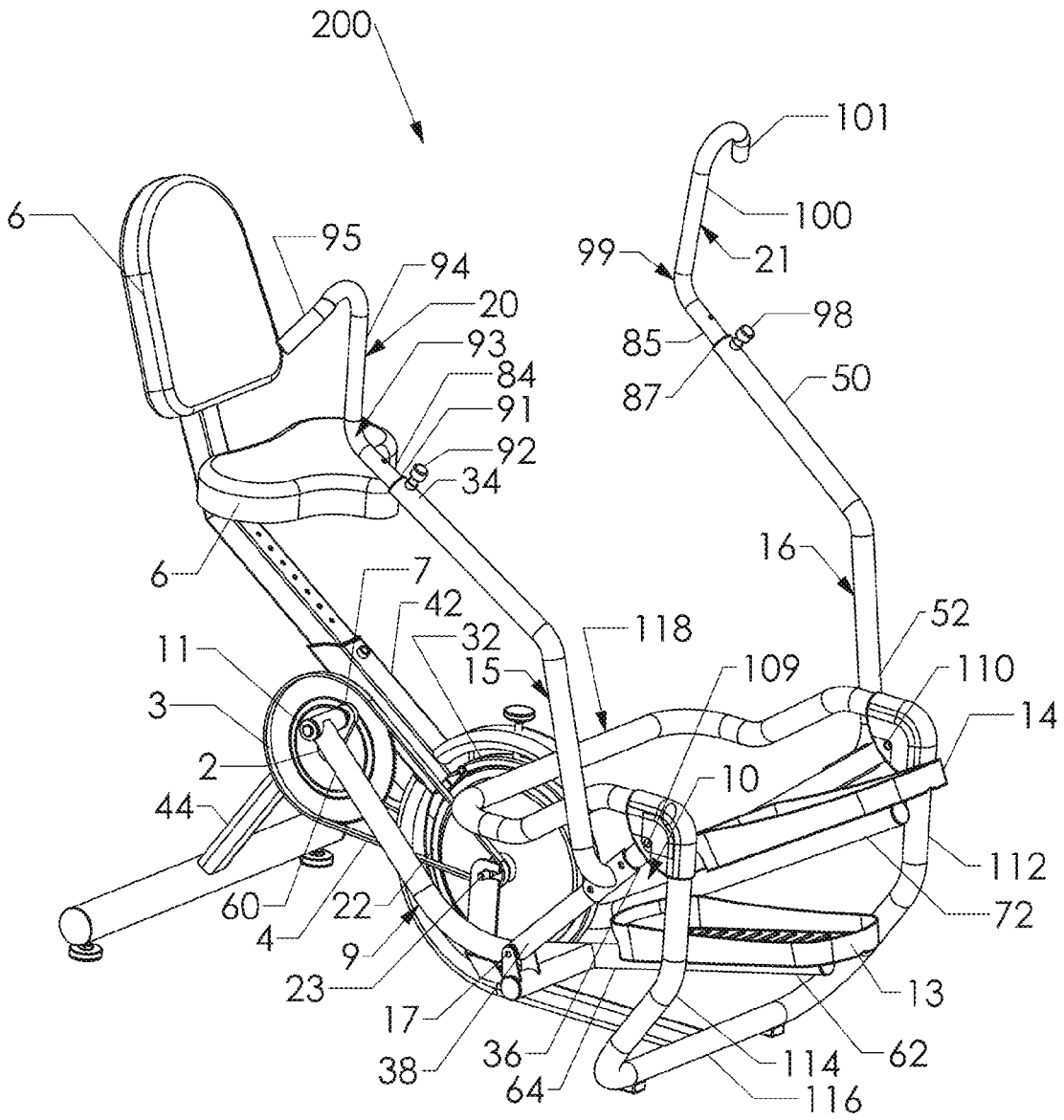
FIG. 9 is a side perspective view of another embodiment of as seated exercise apparatus according to the present invention.
Figure 10:
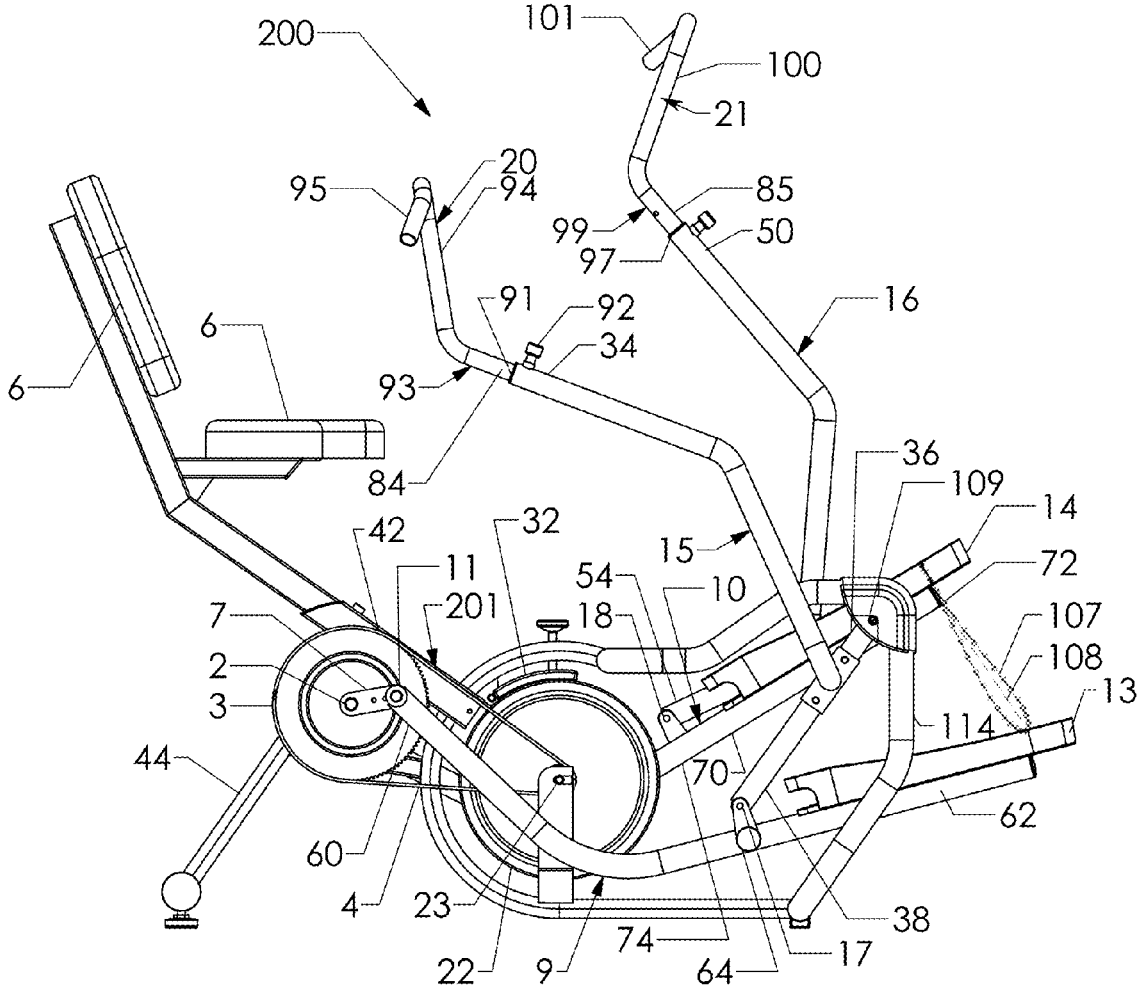
FIG. 10 is a side elevation view of the seated exercise apparatus of FIG. 9.
Figure 11:
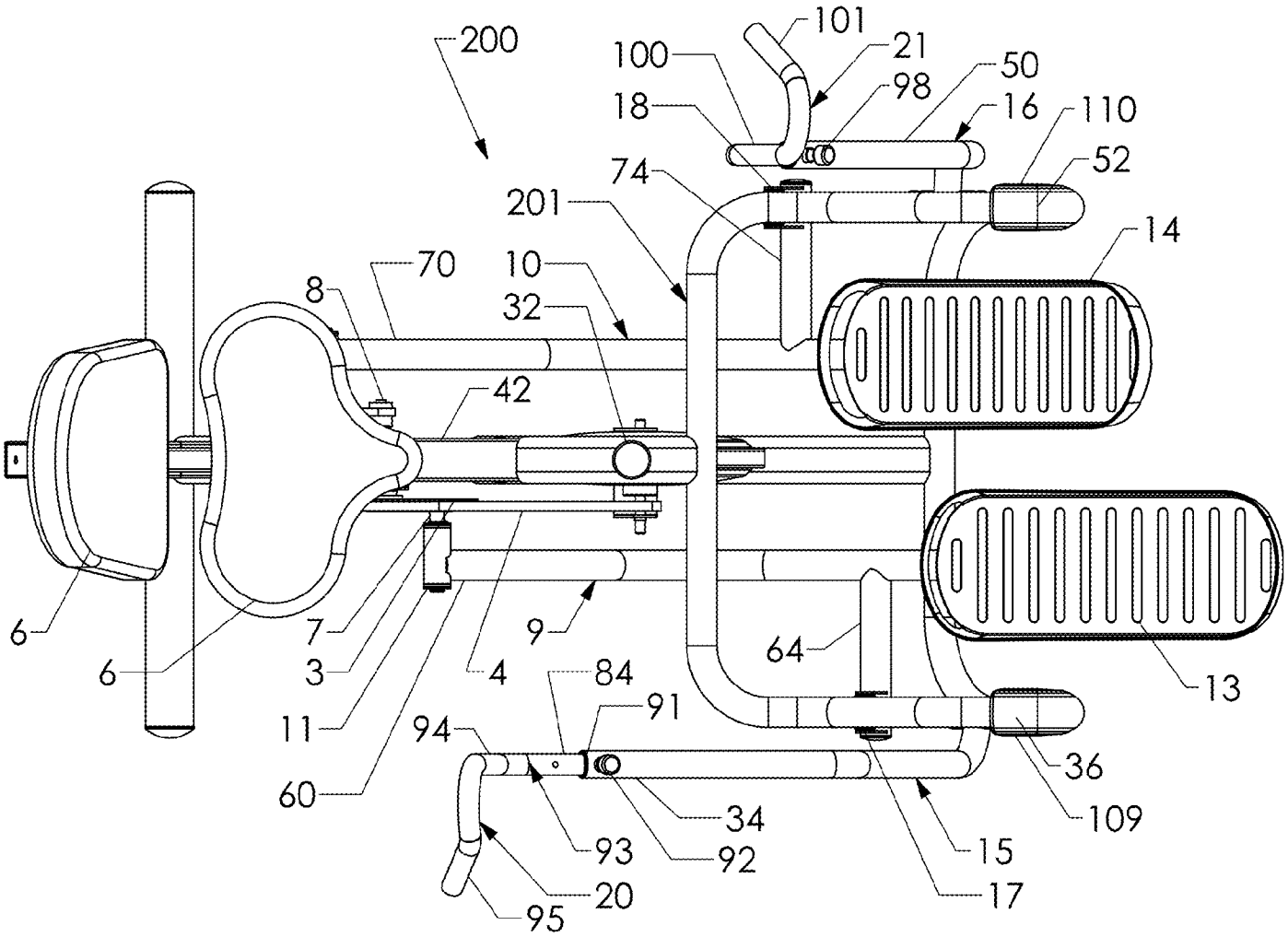
FIG. 11 is a top view of the seated exercise apparatus of FIG. 9.

Turning now to FIGS. 9-11, another embodiment of a seated exercise apparatus 200 is shown. The embodiment of FIGS. 9-11 has many similar components to the seated exercise apparatus 30 embodiment of FIGS. 4-8, but has a significantly different configuration for the frame 201, and the seated exercise apparatus 200 is distinctively designed and configured to have a more compact overall size than the seated exercise apparatus 30, as described below. Accordingly, like reference numerals refer to like elements among the embodiments, and the description of such elements above with respect to FIGS. 1-8 applies equally to the elements shown in FIGS. 9-11. Thus, such descriptions are not repeated, except where necessary to explain the differences.

As explained below, the seated exercise apparatus 200 of FIGS. 9-11 may advantageously be in a more compact form factor than other embodiments. This is accomplished by the innovative configuration of the frame 201, and the relative location of the pivot joints connecting the medial portions of the first and second elongated members to the frame 201. More specifically, and with reference to FIGS. 9-11, the medial portion 36 of the first elongated member 15 is rotatably connected to the frame 201 at a first pivot joint 109 The first pivot joint 109 is located to the outside of the plane of motion of the entire first pedal 13. As used herein, the term "outside" means that one feature is toward the outer perimeter of the apparatus 200 relative to another feature. The plane of motion of the entire first pedal 13 refers to a plane defined by the path of any point on the first pedal 13. In this case, the path 107 (see FIG. 10) of the first pedal 13 is an elongated elliptical shape or a teardrop shape, in which the top part of the path ends in almost a point (very small radius), and the bottom part of the path has a larger minor diameter and a larger radius circular shape. Furthermore, the path 107 is oriented substantially vertical such that the path 107 defines a vertical plane through the first pedal 13. The major axis 108 of the reciprocating path 107 of the first and second pedals 13, 14 is substantially vertical, and preferably at an angle of greater than 45 degrees to horizontal (or the floor) or 60 degrees to horizontal, or at an angle of greater than 70 degrees horizontal, or at an angle of greater than 80 degrees to horizontal (wherein vertical to horizontal is 90 degrees).

In other words, the first pivot joint 36 of the first elongated member 15 is located to the right side (the directional terms "right", "left", "forward" and "backward" are relative to the orientation of a person seated facing forward in the seat of the apparatus) of the plane of motion of the entire first pedal 13. In this way, the first pedal 13 may extend forward of the first pivot joint 109 without hitting or interfering with the first elongated member. Similarly, the medial portion 52 of the second elongated member 16 is rotatably connected to the frame 201 at a second pivot joint 110 which is located to the outside of the plane of motion of the entire second pedal 14. Again, in other words, the second pivot joint 110 of the second elongated member 16 is located to the left side of the plane of motion of the entire second pedal 14, such that the second pedal 14 may extend forward of the second pivot joint 110 without hitting or interfering with the second elongated member.

In order to provide a compact overall form factor, the first and second pivot joints 109 and 110 may also be within a transverse projection of the path of the entire respective pedals 13 and 14. The transverse projection of the path of the entire pedal is a projection perpendicular to the plane of the path of the entire pedal. This may be better understood by visualizing the entire area covered by the motion of a cross-section or outside surface of the entire first pedal 13. This area is a two-dimensional shape lying in a vertical plane (i.e. a plane parallel to the paper in the side view of FIG. 10). Then, the transverse projection of this area is a projection perpendicular to the plane of the path. It can be seen that in the apparatus of FIGS. 9-11, the first pivot joint 109 is located within the transverse projection of the path of the first pedal 13, and the second pivot joint 110 is within the transverse projection of the second pedal 14. This allows the frame of the apparatus to be smaller and the overall size of the apparatus to be smaller than if the pivot joints 109 and 110 were located inside the plane of motion of the pedals such that the pivot joints would need to be located outside (e.g. forward) of the transverse projection of the path of the pedals.

The frame 201 is specifically configured to be routed to the outside of the plane of motion of the first and second pedals 13 and 14 to provide a frame structure for the first and second pivot joints 109 and 110 to be located to the outside of the plane of motion of the pedals 13 and 14. More specifically, the frame 201 has a lower cross bar 116 that extends transverse to the longitudinal axis of the apparatus 200. The lower cross bar 116 extends to the outside of the plane of the pedals 13 and 14 on each side of the apparatus 200. Then, a right front riser 114 extends upward from the lower cross bar 116 on the right side, and a left front riser 112 extends upward from the lower cross bar 116 on the left side. The right front riser 114 and left front riser 112 extend up to the location of the first pivot joint 109 and second pivot joint 110, respectively. The upper end of the right front riser 114 and left front riser 112 are then connected to a u-shaped support bar 118. The u-shaped support bar 118 is also connected to a rear structure of the frame 201, such as the frame structure housing and supporting the flywheel 22, the load resistance device 32, and the seat riser 42, among others.

While embodiments of the present invention have been shown and described, various modifications may be made without departing from the scope of the present invention.

The invention, therefore, should not be limited, except to the following claims, and their equivalents.

What is claimed is:

1. An apparatus for exercising, comprising:

a frame;

a crank axis toward a rear end of the apparatus, said crank axis being substantially perpendicular to a longitudinal axis of said apparatus;

a frame a seat attached to said frame, said seat adapted to support a user in a seated position;

first and second cranks, each having a first end and a second end, each of said first ends of said first and second cranks rotatably coupled to the frame at said crank axis such that the first and second cranks rotate about said crank axis;

first and second elongated members each having a first end, a second end, and a medial portion, the medial portion of said first elongated member rotatably connected to said frame at a first pivot joint, and said medial portion of said second elongated member rotatably connected to said frame at a second pivot joint;

first and second pedal arms each having a first end, a second end and a pivot portion between said first end and said second end, said first end of said first pedal arm rotatably connected to said second end of said first crank, said pivot portion of said first pedal arm rotatably connected to said second end of said first elongated member at a first pivot, said first end of said second pedal arm rotatably connected to said second end of said second crank, said pivot portion of said second pedal arm rotatably connected to said second end of said second elongated member at a second pivot;

first and second pedals each configured to support a foot of the user, said first pedal operably connected to said first pedal arm proximate said second end of said first pedal arm, said second pedal operably connected to said second pedal arm proximate said second end of said second pedal arm, whereby said first and second pedals move in a generally reciprocating pattern defining a plane of motion of the first pedal and a plane of motion of the second pedal;

wherein the first pivot joint is located to the outside of the plane of motion of the first pedal and the second pivot joint is located to the outside of the plane of motion of the second pedal; and wherein the first pivot joint is located within a transverse projection of a path of the first pedal, and the second pivot joint is located within a transverse projection of a path of the second pedal.

2. The apparatus of claim 1, further comprising;

a first handle attached to said first end of said first elongated member; and a second handle attached to said first end of said second elongated member.

3. The apparatus of claim 2, wherein said first and second handles are adjustable between an upper position and a lower position, the upper position being higher than the lower position, relative to the first end of the elongated member to which the handles are attached.

4. The apparatus of claim 3, wherein said first end of said first elongated member has a first slider tube and a first locking device, said first handle comprises a first tubular portion, a first vertical grip and a first horizontal grip, said first tubular portion slidably received within said first slider tube, and said first locking device configured to releasably lock said first handle in a fixed position on said first end of said first elongated member; and said first end of said second elongated member has a second slider tube and a second locking device, said second handle comprises a second tubular portion, a second vertical grip and a second horizontal grip, said second tubular portion slidably received within said second slider tube, and said second locking device configured to releasably lock said second handle in a fixed position on said first end of said second elongated member.

5. The apparatus of claim 1 further comprising a pulley to which said first and second cranks are attached, said pulley rotatably connected to said frame and configured to rotate about said crank axis.

6. The apparatus of claim 5 further comprising a load resistance device operably coupled to said pulley and configured to provide an adjustable load resistance on said pulley.

7. The apparatus of claim 1, wherein the frame is configured to extend to the outside of the plane of motion of the first pedal on a right side of the apparatus and to the outside of the plane of motion of the second pedal on a left side of the apparatus.

8. The apparatus of claim 1, wherein a major axis of said path forms an acute angle of greater than 45 degrees from horizontal.

9. The apparatus of claim 1 wherein said first pedal is rigidly connected to said first pedal arm, and said second pedal is rigidly connected to said second pedal arm.

10. The apparatus of claim 1, wherein said first pedal is operably connected to said first pedal arm in front of said first pivot.

11. The apparatus of claim 1, further comprising an adjustable load resistance device operably coupled to said first and second cranks.

* * * * *